US010583899B2

(12) United States Patent
Yang

(10) Patent No.: US 10,583,899 B2
(45) Date of Patent: Mar. 10, 2020

(54) LIGHTHOUSE LANTERN FOR LIGHTHOUSE USING LASER DIODE AND FLUORESCENT SUBSTANCE

(71) Applicant: PUKYONG NATIONAL UNIVERSITY INDUSTRY—UNIVERSITY COOPERATION FOUNDATION, Busan (KR)

(72) Inventor: Hyun Kyoung Yang, Busan (KR)

(73) Assignee: PUKYONG NATIONAL UNIVERSITY INDUSTRY-UNIVERSITY COOPERATION FOUNDATION, Busan (KR)

( * ) Notice: Subject to any disclaimer, the term of this patent is extended or adjusted under 35 U.S.C. 154(b) by 35 days.

(21) Appl. No.: 15/769,230

(22) PCT Filed: Jan. 4, 2017

(86) PCT No.: PCT/KR2017/000092
§ 371 (c)(1),
(2) Date: Apr. 18, 2018

(87) PCT Pub. No.: WO2017/119712
PCT Pub. Date: Jul. 13, 2017

(65) Prior Publication Data

US 2018/0304974 A1 Oct. 25, 2018

(30) Foreign Application Priority Data

Jan. 5, 2016 (KR) ..... 10-2016-0000765

(51) Int. Cl.
*B63B 22/16* (2006.01)
*F21V 7/04* (2006.01)
(Continued)

(52) U.S. Cl.
CPC ..... *B63B 22/16* (2013.01); *B63B 51/00* (2013.01); *F21K 9/60* (2016.08); *F21V 5/04* (2013.01);
(Continued)

(58) Field of Classification Search
CPC . B63B 51/00; B63B 22/16; F21V 5/04; F21V 7/0025; F21V 7/04; F21V 7/041;
(Continued)

(56) References Cited

U.S. PATENT DOCUMENTS 4,328,136 A 5/1982 Blount
5,126,923 A * 6/1992 Hall, II ..... B60Q 1/2611 362/282
(Continued)

FOREIGN PATENT DOCUMENTS

JP 3023510 4/1996
JP 2002-305966 10/2002
(Continued)

OTHER PUBLICATIONS

International Search Report issued in International Patent Application No. PCT/KR2017/000092, dated Apr. 11, 2017.

*Primary Examiner* — Mary Ellen Bowman
(74) *Attorney, Agent, or Firm* — Norton Rose Fulbright US LLP

(57) ABSTRACT

A lighthouse lantern comprising a power supply and a phosphor-containing emitter is disclosed. The lighthouse lantern includes a power supply; a laser diode configured for receiving power from the power supply and irradiating laser in one direction; a phosphor-containing emitter positioned on a traveling line of the laser, wherein the emitter is configured for receiving the laser and emitting light; and a pair of reflective structures disposed symmetrically with respect to the phosphor-containing emitter, wherein each
(Continued)

reflective structure has a reflective surface inclined in a direction away from the phosphor-containing emitter, wherein the reflective surfaces of the reflective structures are symmetrical with each other with respect to the phosphor-containing emitter. In accordance with the present disclosure, the lighthouse lantern may generate high output with low input power and thus has improved power efficiency, may suppress frequent failures near sea or seawater, and may reduce production costs.

5 Claims, 3 Drawing Sheets

(51) Int. Cl.

| | |
|---|---|
| ***F21V 9/30*** | (2018.01) |
| ***F21V 7/00*** | (2006.01) |
| ***B63B 51/00*** | (2006.01) |
| ***F21V 5/04*** | (2006.01) |
| ***F21V 23/02*** | (2006.01) |
| ***F21K 9/60*** | (2016.01) |
| ***F21Y 101/00*** | (2016.01) |
| ***F21W 111/00*** | (2006.01) |

(52) U.S. Cl.
CPC ..... *F21V 7/0025* (2013.01); *F21V 7/04* (2013.01); *F21V 7/041* (2013.01); *F21V 9/30* (2018.02); *F21V 23/02* (2013.01); *F21W 2111/00* (2013.01); *F21Y 2101/00* (2013.01)

(58) Field of Classification Search
CPC .. F21V 23/02; F21K 9/60; F21K 9/30; F21W 2111/00; F21Y 2101/00
See application file for complete search history.

(56) References Cited

U.S. PATENT DOCUMENTS

| | | | | |
|---|---|---|---|---|
| 5,584,571 | A * | 12/1996 | Chandler | H05B 37/029 315/200 A |
| 8,348,468 | B2 * | 1/2013 | Hattori | F21K 9/64 257/100 |
| 2003/0156416 | A1 * | 8/2003 | Stopa | B64D 7/02 362/294 |

FOREIGN PATENT DOCUMENTS

| | | |
|---|---|---|
| JP | 2007-294754 | 11/2007 |
| JP | 2011-187291 | 9/2011 |
| KR | 10-0657989 | 12/2006 |
| KR | 10-2008-0039581 | 5/2008 |
| KR | 10-2014-0132059 | 11/2014 |

* cited by examiner

【FIG. 1】
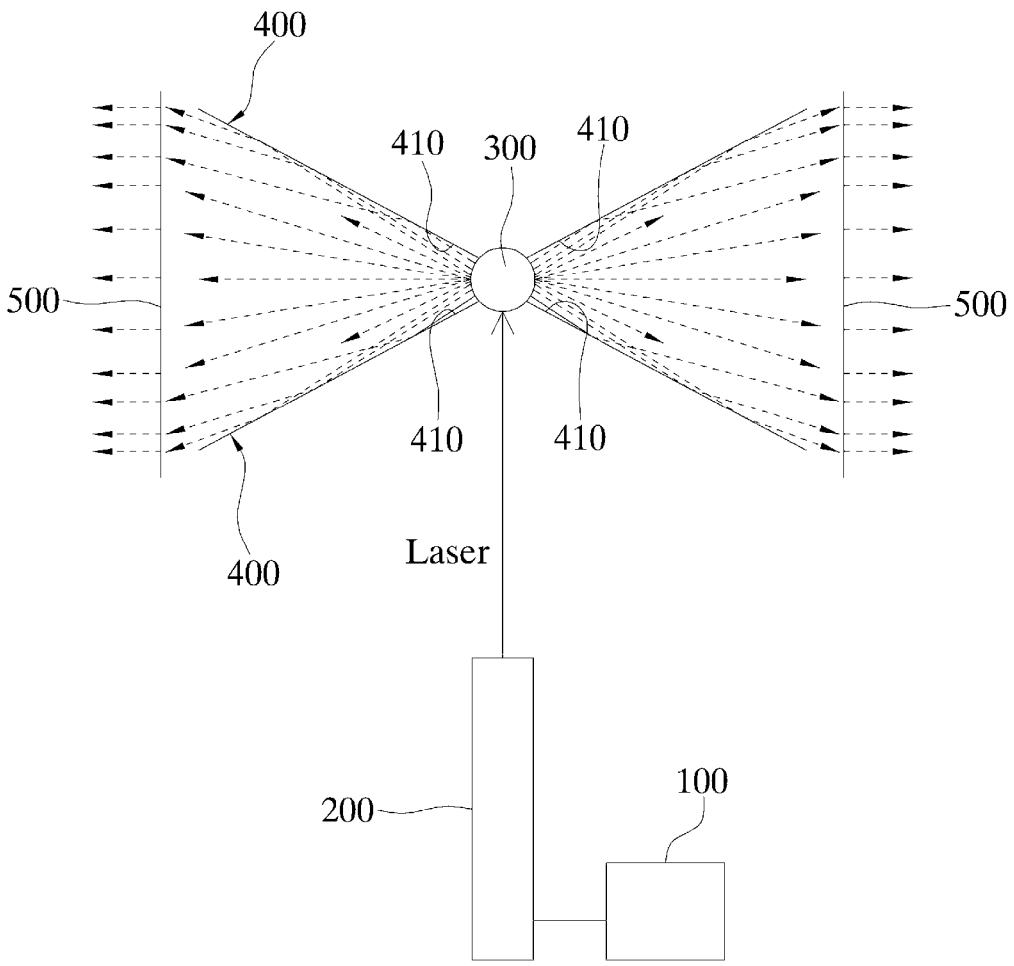

【FIG. 2】
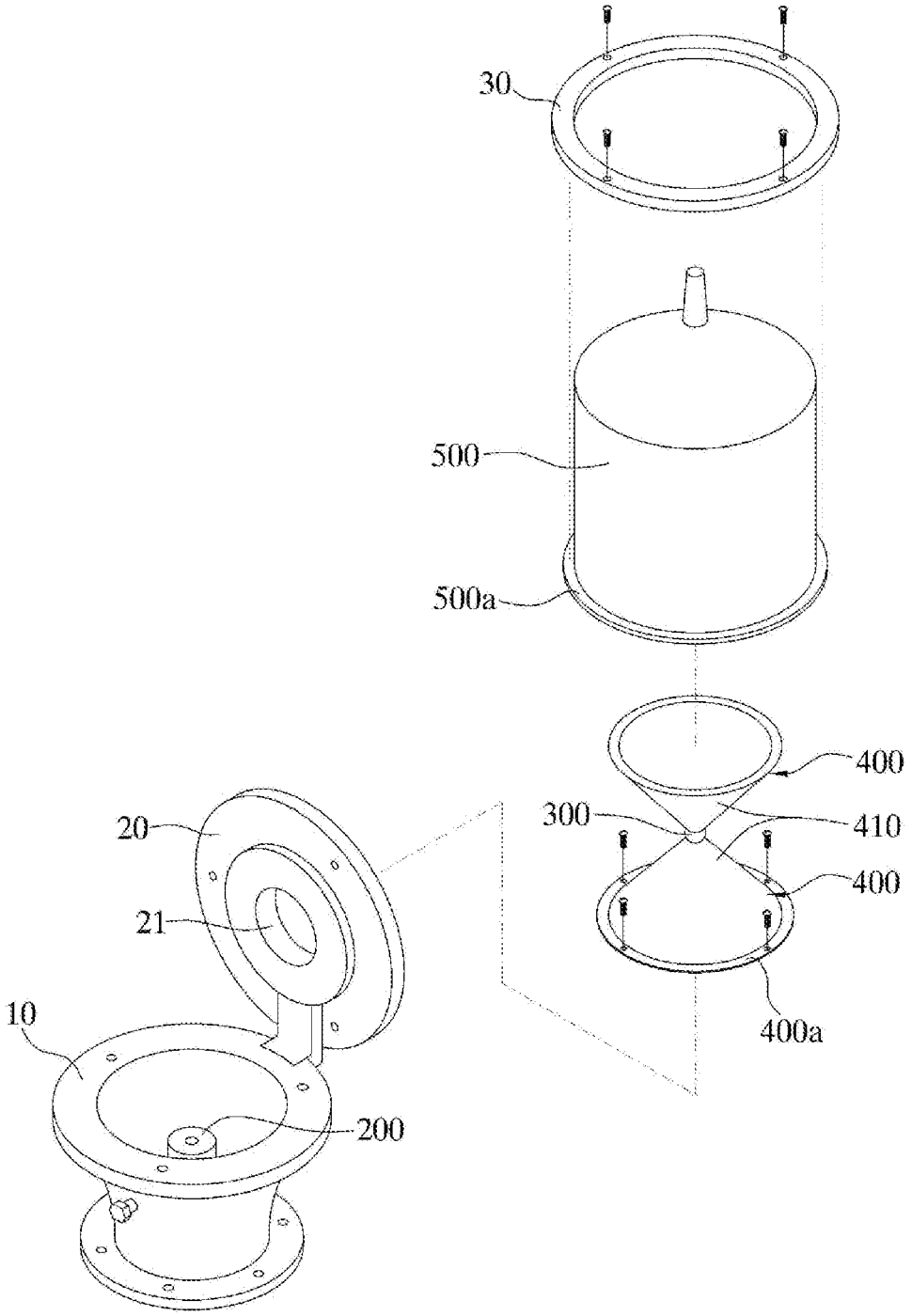

【FIG. 3】
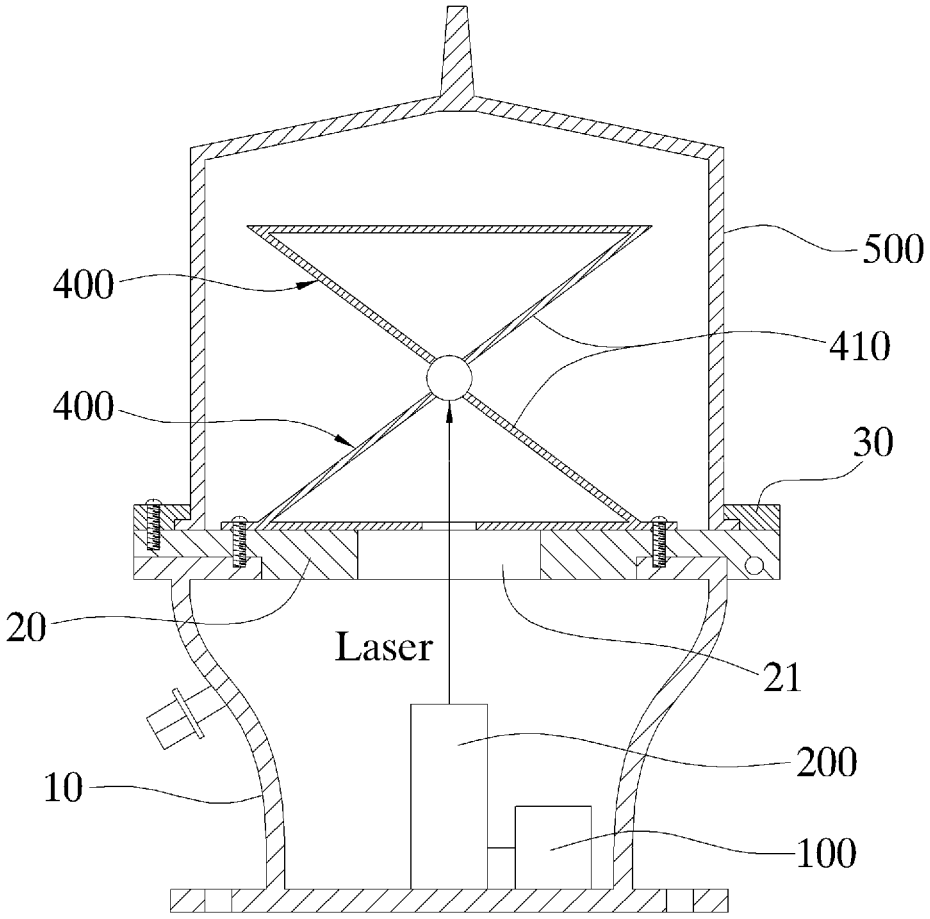

LIGHTHOUSE LANTERN FOR LIGHTHOUSE USING LASER DIODE AND FLUORESCENT SUBSTANCE

This application is a national phase under 35 U.S.C. § 371 of International Application No. PCT/KR2017/000092 filed Jan. 4, 2017, which claims the benefit of priority to Korean Patent Application Ser. No. 10-2016-0000765, filed Jan. 5, 2016. The entire contents of each of the referenced applications are incorporated into the present application by reference.

TECHNICAL FIELD

The present disclosure relates to a lighthouse lantern, and more specifically, to a lighthouse lantern with production of high output at low input power.

RELATED ART

In a lighthouse lantern using a conventional incandescent lamp, a plurality of incandescent lamps are installed in a mechanical structure called a bulb exchanger. Therefore, when the incandescent bulb which is currently in operation fails, the motor mounted in the bulb exchanger is driven such that the problematic bulb is automatically replaced with a spare bulb.

However, in such a bulb type lighthouse lantern, inefficient use of electric power requires frequent inspection and maintenance of an electric power unit. Due to the shortened durability of the battery, frequent inspections of a manager are required.

Accordingly, recently, a lighthouse lantern using an LED having a higher luminance than an incandescent lamp has been developed and used. In such an LED-based lighthouse lantern, LED modules emitting light are stacked in a lighthouse lantern body. Each LED module is electrically connected to the power supply of the control module and is designed to operate by the power supplied from the battery.

In a conventional lighthouse lantern using an LED, the luminous intensity of the LED module itself is relatively higher than that of an incandescent lamp. However, when the stack of these LED modules is used, the light emitting area of the light radiated from the LED to the outside is narrowed due to the cover plate pressing the lens portion of the LED module upward and downward. There is a problem that the luminous intensity in such a portion is relatively lower than that of the lens portion of the LED module and the overall brightness of the lighthouse lantern is lowered.

On the other hand, lighthouse lanterns are mostly used at sea or near seawater. In this regard, in the case of a conventional lighthouse lantern using LED, a failure frequently occurs due to the corrosion of the LED module.

SUMMARY

The present disclosure is intended to provide a lighthouse lantern that may generate high output with low input power and thus has improved power efficiency, that may suppress frequent failures near sea or seawater, and that may reduce production costs.

In one aspect, there is provided a lighthouse lantern comprising: a power supply; a laser diode configured for receiving power from the power supply and irradiating laser in one direction; a phosphor-containing emitter positioned on a traveling line of the laser, wherein the emitter is configured for receiving the laser and emitting light; and a pair of reflective structures disposed symmetrically with respect to the phosphor-containing emitter, wherein each reflective structure has a reflective surface inclined in a direction away from the phosphor-containing emitter, wherein the reflective surfaces of the reflective structures are symmetrical with each other with respect to the phosphor-containing emitter.

In one embodiment, the phosphor-containing emitter includes an inorganic material base body with a predetermined shape, and phosphors dispersed in the base body. In one embodiment, the phosphors include at least one selected from a group consisting of $(Y,Tb)_2Al_5O_{12}:Ce^{3+}$, $(Sr,Ba,Ca)_2Si_5N_8:Eu^{2+}$, $CaAlSiN_3:Eu^{2+}$, $BaMgAl_{10}O_{17}:Eu^{2+}$, $BaMgAl_{10}O_{17}:Eu^{2+},Mn^{2+}$, Ca-alpha-SiAlON:$Eu^{2+}$, Beta-SiAlON:$Eu^{2+}$, $(Ca,Sr,Ba)_2P_2O_7:Eu^{2+}$, $(Ca,Sr,Ba)_2P_2O_7:Eu^{2+}, Mn^{2+}$, $(Ca,Sr,Ba)_5(PO_4)_3Cl:Eu^{2+}$, $Lu_2SiO_5:Ce^{3+}$, $(Ca,Sr,Ba)_3SiO_5:Eu^{2+}$, $(Ca,Sr,Ba)_2SiO_4:Eu^{2+}$, $Zn_2SiO_4:Mn^{2+}$, $BaAl_{12}O_{19}:Mn^{2+}$, $BaMgAl_{14}O_{23}:Mn^{2+}$, $SrAl_{12}O_{19}:Mn^{2+}$, $CaAl_{12}O_{19}:Mn^{2+}$, $YBO_3:Tb^{3+}$, $LuBO_3:Tb^{3+}$, $Y_2O_3:Eu^{3+}$, $Y_2SiO_5:Eu^{3+}$, $Y_3Al_5O_{12}:Eu^{3+}$, $YBO_3:Eu^{3+}$, $Y_{0.65}Gd_{0.35}BO_3:Eu^{3+}$, $GdBO_3:Eu^{3+}$ and $YVO_4:Eu^{3+}$.

In one embodiment, each of the pair of reflective structures has a conical shape, wherein vertex portions of the cones of the pair of reflective structures are positioned on a traveling line of the laser, wherein the phosphor-containing emitter is in contact with the vertex portions of the cone, wherein the vertex portion of one of the pair of reflective structures is open such that the laser is incident on the phosphor-containing emitter.

In accordance with the present disclosure, the lighthouse lantern may generate high output with low input power and thus has improved power efficiency, may suppress frequent failures near sea or seawater, and may reduce production costs.

BRIEF DESCRIPTION OF THE DRAWINGS

FIG. 1 shows a schematic configuration of a lighthouse lantern according to the present disclosure.

FIG. 2 is an exploded perspective view showing one embodiment of a lighthouse lantern according to the present disclosure.

FIG. 3 is a cross-sectional view of an assembled assembly of the disassembled components of FIG. 2.

DETAILED DESCRIPTIONS

Hereinafter, a lighthouse lantern including a laser diode and a phosphor-containing emitter according to an embodiment of the present disclosure will be described in detail with reference to the accompanying drawings. Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims. For simplicity and clarity of illustration, elements in the figures are not necessarily drawn to scale. The same reference numbers in different figures denote the same or similar elements, and as such perform similar functionality.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 shows a schematic configuration of a lighthouse lantern according to the present disclosure.

Referring to FIG. 1, a lighthouse lantern according to an embodiment of the present disclosure includes a power supply 100, a laser diode (LD) 200, a phosphor-containing emitter 300, and a pair of reflective structures 400.

The power supply 100 supplies power to the laser diode 200. The power supply 100 may be configured to supply external commercial power, or may be configured in the form of a solar cell.

The laser diode 200 receives power from a power supply 100 to emit a laser beam. The laser diode 200 is an element that amplifies light by induction emission. The light output from the laser diode 200 is excellent in monochromaticity, has a uniform phase, does not spread during traveling, and is excellent in convergence. Because of these features, laser diodes have higher power than LEDs. The laser diode 200 may be the smallest and lightest among all kinds of lasers, and may be mass-produced at low cost using the semiconductor process. The laser diode 200 irradiates the laser in one direction.

The phosphor-containing emitter 300 receives the laser emitted from the laser diode 200 and emits light. The phosphor-containing emitter 300 is positioned on the traveling line of the laser so that light from the laser diode 200 is incident on the phosphor-containing emitter 300. The phosphor-containing emitter 300 may have an inorganic material base and phosphor particles dispersed in the base. For example, the phosphor-containing emitter 300 includes an inorganic material base such as glass, transparent ceramic, or single crystal single crystal. Phosphor particles may be dispersed in the inorganic material base.

In one example, the phosphor may include at least one selected from a group consisting of $(Y,Tb)_2Al_5O_{12}:Ce^{3+}$, $(Sr,Ba,Ca)_2Si_5N_8:Eu^{2+}$, $CaAlSiN_3:Eu^{2+}$, $BaMgAl_{10}O_{17}:Eu^{2+}$, $BaMgAl_{10}O_{17}:Eu^{2+},Mn^{2+}$, Ca-alpha-SiAlON:$Eu^{2+}$, Beta-SiAlON:$Eu^{2+}$, $(Ca,Sr,Ba)_2P_2O_7:Eu^{2+}$, $(Ca,Sr,Ba)_2P_2O_7:Eu^{2+}$, $Mn^{2+}$, $(Ca,Sr,Ba)_5(PO_4)_3Cl:Eu^{2+}$, $Lu_2SiO_5:Ce^{3+}$, $(Ca,Sr,Ba)_3SiO_5:Eu^{2+}$, $(Ca,Sr,Ba)_2SiO_4:Eu^{2+}$, $Zn_2SiO_4:Mn^{2+}$, $BaAl_{12}O_{19}:Mn^{2+}$, $BaMgAl_{14}O_{23}:Mn^{2+}$, $SrAl_{12}O_{19}:Mn^{2+}$, $CaAl_{12}O_{19}:Mn^{2+}$, $YBO_3:Tb^{3+}$, $LuBO_3:Tb^{3+}$, $Y_2O_3:Eu^{3+}$, $Y_2SiO_5:Eu^{3+}$, $Y_3Al_5O_{12}:Eu^{3+}$, $YBO_3:Eu^{3+}$, $Y_{0.65}Gd_{0.35}BO_3:Eu^{3+}$, $GdBO_3:Eu^{3+}$ and $YVO_4:Eu^{3+}$.

The phosphor-containing emitter 300 is preferably spherical in order to emit light in multiple directions.

A pair of the reflective structures 400 reflect light emitted from the phosphor-containing emitter 300 and scatter in multiple directions. Each of the reflective structures 400 includes an outer reflective surface 410. The phosphor-containing emitter 300 is disposed between the reflective structures 400. The reflective structures 400 are symmetrical with respect to the phosphor-containing emitter 300. The reflective surface 410 is formed to be inclined in a direction away from the phosphor-containing emitter 300. For example, each of the reflective structures 400 may be configured to be inclined in a direction away from one vertex. When the phosphor-containing emitter 300 located between the reflective surfaces 410 emits light, such a pair of reflective structures 400 reflects the emitted light and may scatter around the phosphor-containing emitter 300.

Meanwhile, the lighthouse lantern according to the present disclosure further includes a Fresnel lens 500.

The Fresnel lens 500 is a lens that converts diffused light beams diffused from a point light source into linear light beams close to the laser. Thus, the light emitted from the phosphor-containing emitter 300 is reflected on the reflective surfaces 410 of the pair of reflective structures 400 and then is converted to have a directivity through the Fresnel lens 500. To this end, the Fresnel lens 500 is disposed around the pair of reflective structures 400 to surround the pair of reflective structures 400.

FIG. 2 is an exploded perspective view showing one embodiment of a lighthouse lantern according to the present disclosure. FIG. 3 is a cross-sectional view of an assembled assembly of the disassembled components of FIG. 2.

Referring to FIG. 2 and FIG. 3, according to one embodiment of the present disclosure, the laser diode 200 and the power supply 100 may be installed in a cylindrical lighthouse body 10. In this connection, the laser diode 200 may be installed to illuminate the laser toward the top of the lighthouse body 10. For example, the laser diode 200 may emit blue light having a wavelength range of about 475 nm (for example, between 400 nm and 550 nm).

The lighthouse lantern body 10 may be combined with a lid 20, which covers the top of lighthouse body 10. For example, the lid 20 may be pivotally connected to the top of the lighthouse body 10 at one side thereof. In the center of the lid 20, an opening 21 through which the laser irradiated from the laser diode 200 passes may be formed.

The top face of the lid 20 may be combined with a pair of reflective structures 400. In one example, each reflective structure 400 may be conical. In this case, each reflective surface 410 is formed obliquely away from the vertex of the conical shape. The reflective structures 400 may be arranged symmetrically with respect to each other such that the vertexes of the conical shape are located on the laser traveling line. The configuration in which the pair of reflective structures 400 are coupled to the top face of the lid 20 is not particularly limited. For example, a flange **400*a* may be disposed about the bottom of a lower reflective structure 400 that is coupled to the top face of the lid 20. The lower reflective structure 400 may be coupled to the lid 20 with the flange 400***a*. The lower reflective structure 400 may be open at a position corresponding to the vertex so that the laser passes through the opening.

The phosphor-containing emitter 300 is provided between the pair of reflective structures 40*o*. The phosphor-containing emitter 300 is provided in spherical form. In this connection, the phosphor-containing emitter 300 is located on the vertex of the cone. The phosphor-containing emitter 300 is disposed on the open vertex portion of the lower reflective structure 400 coupled with the lid 20. When the laser is incident on the phosphor-containing emitter 300, the emitter emits light. For example, the light emitted from the phosphor-containing emitter 300 may have a wavelength close to that of white light.

The Fresnel lens 500 may be coupled to the top face of the lid 20 to surround the pair of reflective structures 400. For example, the Fresnel lens 500 may have a hollow cylindrical shape with the top face closed and the bottom open. The configuration in which the Fresnel lens 500 is coupled to the top face of the lid 20 is not particularly limited. For example, an annular portion 500*a* is formed at and around the lower end of the cylindrical shape of the Fresnel lens 500. An annular fixing ring 30 pressing the annular portion 500*a* is coupled to the lid 20, thereby fixing the Fresnel lens 500 to the lid 20.

Although not shown, a control module may be installed inside the lighthouse body 10 to receive power from the power supply 100 and to control the power supply from the power supply 100 to the laser diode 200.

Hereinafter, a process in which the phosphor-containing emitter emits light and the lighthouse lantern emits light will be explained.

First, the laser diode 200 is powered from the power supply 100 and irradiates the laser toward the phosphor-containing emitter 300.

The irradiated laser passes through the opening 21 of the lid 20 and the open vertex portion of the cone of the reflective structure 400 bonded to the lid 20, and then enters the phosphor-containing emitter 300.

When the laser is incident on the phosphor-containing emitter 300, the phosphor-containing emitter 300 may emit light close to the white light.

The light emitted from the phosphor-containing emitter 300 is reflected on the reflective surfaces 410 of the pair of reflective structures 400. That is, light is reflected on the reflective surfaces 410 and scattered in multiple directions. Thereafter, the light travels toward the Fresnel lens 500.

The light scattered from the pair of reflective structures 400 passes through the Fresnel lens 500 and becomes straight. Thus, the light emits in a 360-degree direction around the Fresnel lens 500.

The lighthouse lantern according to the present disclosure is configured to emit light using the laser diode 200 and the phosphor-containing emitter 300. As mentioned above, the laser diode 200 has a characteristic of excellent convergence without spreading in progress, and has a higher output than LED. When the laser irradiated from the laser diode 200 is incident into the phosphor-containing emitter 300, the phosphor-containing emitter 300 may emit light at a high output. Therefore, the lighthouse lantern according to the present disclosure may generate a high output even at a low input power as compared with the conventional technology using the LED as the light emitting source. As a result, a power efficiency improvement of more than 50% may be expected in accordance with the present disclosure.

Further, since the substrate having the LED chip used as in the prior art is not employed by the present disclosure, a failure due to corrosion of the light emitting module may be prevented.

In addition, the production cost of the lighthouse lantern may be reduced by using the laser diode 200 capable of mass production at a low cost.

The description of the disclosed embodiments is provided to enable any person of ordinary skill in the art to make or use the present disclosure. Various modifications to these embodiments will be readily apparent to those of ordinary skill in the art of the present disclosure. Further, the generic principles defined herein may be applied to other embodiments without departing from the scope of the present disclosure. Accordingly, the present disclosure is not to be limited to the embodiments set forth herein but is to be accorded the widest scope consistent with the principles and novel features presented herein.

What is claimed is:

1. A lighthouse lantern comprising:

a power supply;

a laser diode configured for receiving power from the power supply and irradiating laser in one direction;

a phosphor-containing emitter positioned on a traveling line of the laser, wherein the emitter is configured for receiving the laser and emitting light; and a pair of reflective structures disposed symmetrically with respect to the phosphor-containing emitter, wherein each reflective structure has a reflective surface inclined in a direction away from the phosphor-containing emitter, wherein the reflective surfaces of the reflective structures are symmetrical with each other with respect to the phosphor-containing emitter, wherein each of the pair of reflective structures has a conical shape, wherein vertex portions of the cones of the pair of reflective structures are positioned on a traveling line of the laser, wherein the phosphor-containing emitter is in contact with the vertex portions of the cone, wherein the vertex portion of one of the pair of reflective structures is open such that the laser is incident on the phosphor-containing emitter.

2. The lighthouse lantern of claim 1, wherein the lighthouse lantern further comprises a Fresnel lens disposed around the pair of reflective structures.

3. The lighthouse lantern of claim 1, wherein the phosphor-containing emitter includes an inorganic material base body with a predetermined shape, and phosphors dispersed in the base body.

4. The lighthouse lantern of claim 1, wherein the phosphors include at least one selected from a group consisting of $(Y,Tb)_2Al_5O_{12}:Ce^{3+}$, $(Sr,Ba,Ca)_2Si_5N_8:Eu^{2+}$, $CaAlSiN_3:Eu^{2+}$, $BaMgAl_{10}O_{17}:Eu^{2+}$, $BaMgAl_{10}O_{17}:Eu^{2+}, Mn^{2+}$, Ca-alpha-SiAlON:$Eu^{2+}$, Beta-SiAlON:$Eu^{2+}$, $(Ca,Sr,Ba)_2P_2O_7:Eu^{2+}$, $(Ca,Sr,Ba)_2P_2O_7:Eu^{2+},Mn^{2+}$, $(Ca,Sr,Ba)_5(PO_4)_3Cl:Eu^{2+}$, $Lu_2SiO_5:Ce^{3+}$, $(Ca,Sr,Ba)_3SiO_5:Eu^{2+}$, $(Ca,Sr,Ba)_2SiO_4:Eu^{2+}$, $Zn_2SiO_4:Mn^{2+}$, $BaAl_{12}O_{19}:Mn^{2+}$, $BaMgAl_{14}O_{23}:Mn^{2+}$, $SrAl_{12}O_{19}:Mn^{2+}$, $CaAl_{12}O_{19}:Mn^{2+}$, $YBO_3:Tb^{3+}$, $LuBO_3:Tb^{3+}$, $Y_2O_3:Eu^{3+}$, $Y_2SiO_5:Eu^{3+}$, $Y_3Al_5O_{12}:Eu^{3+}$, $YBO_3:Eu^{3+}$, $Y_{0.65}Gd_{0.35}BO_3:Eu^{3+}$, $GdBO_3:Eu^{3+}$and $YVO_4:Eu^{3+}$.

5. The lighthouse lantern of claim 1, wherein the phosphor-containing emitter has a spherical shape.

* * * * *